US005545445A

United States Patent [19]

Cheng

[11] Patent Number: 5,545,445

[45] Date of Patent: Aug. 13, 1996

[54] DECORATIVE THREE-DIMENSIONAL, CURLED BOW AND METHOD OF MAKING SAME

[76] Inventor: Peter S. C. Cheng, 99 Glencairn Street, Toronto, Ontario, Canada, M4R 1M7

[21] Appl. No.: 302,499

[22] Filed: Sep. 8, 1994

[51] Int. Cl.[6] ..... D04D 7/10

[52] U.S. Cl. ..... 428/4; 28/147; 223/46

[58] Field of Search ..... 428/4, 12, 24, 428/26, 5; 28/147; 223/46

[56] References Cited

U.S. PATENT DOCUMENTS

| | | | |
|---|---|---|---|
| 2,132,616 | 10/1938 | Hardie | 428/230 X |
| 2,594,229 | 4/1952 | Snyder et al. | 428/522 X |
| 2,681,525 | 6/1954 | James | 428/5 |
| 2,826,523 | 3/1958 | Blaszkowski et al. | 428/12 |
| 2,956,362 | 10/1960 | James | 428/5 |
| 3,030,719 | 4/1962 | Enomoto | 428/5 X |
| 3,560,313 | 2/1971 | Herkimer | 428/4 |
| 3,632,464 | 1/1972 | Grikis | 428/4 |
| 3,676,277 | 7/1972 | Truskolaski | 428/4 |
| 3,899,807 | 8/1975 | Sovish et al. | 428/124 X |
| 4,014,088 | 3/1977 | Oshier | 428/24 X |
| 4,137,352 | 1/1979 | Stonebridge | 428/5 X |
| 4,515,837 | 5/1985 | Cheng | 428/4 |
| 4,638,513 | 1/1987 | Woods | 2/268 |
| 4,656,064 | 4/1987 | Cheng | 428/4 |
| 4,822,648 | 4/1989 | Cheng | 428/4 |
| 4,840,822 | 6/1989 | Cheng | 428/4 |
| 4,900,632 | 2/1990 | McGrath | 428/5 X |
| 4,938,348 | 7/1990 | Cheng | 428/4 X |
| 5,240,750 | 8/1993 | Cheng | 428/5 |
| 5,324,564 | 6/1994 | Chiotis et al. | 428/349 X |

*Primary Examiner*—Henry F. Epstein
*Attorney, Agent, or Firm*—Kirschstein, et al.

[57] ABSTRACT

A three-dimensional, curled decorative bow has curls arranged in a bow-like pattern. Each curl is formed of a laminate of two ribbons, one being elastic. The curl may be straightened and shipped in a flattened package.

4 Claims, 1 Drawing Sheet

FIG.1
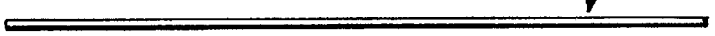
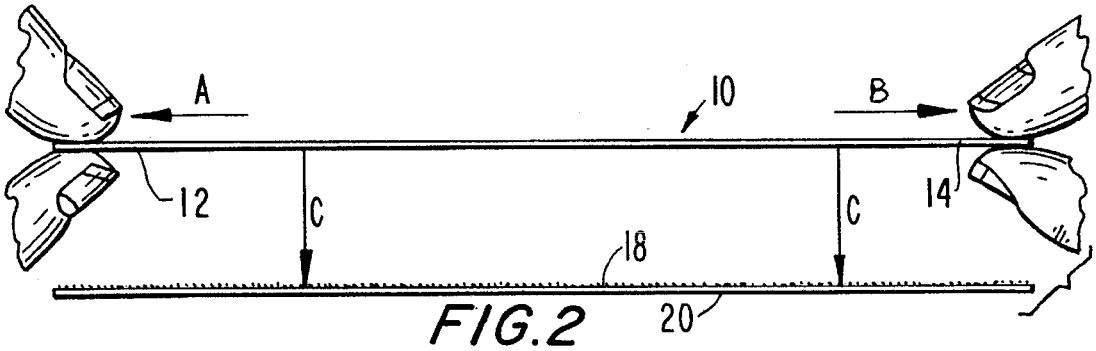
FIG.2
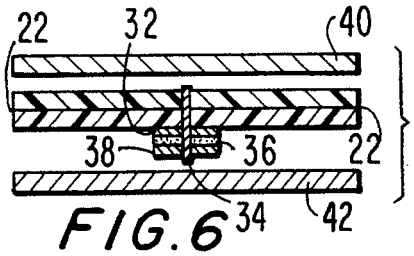
FIG.6
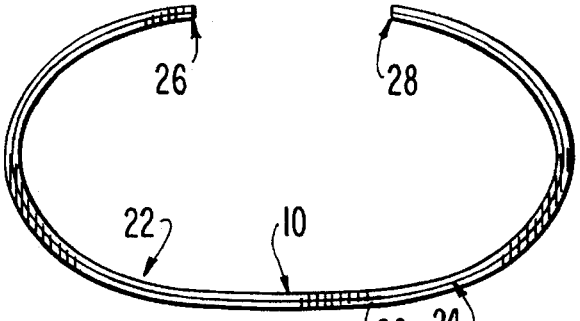
FIG.3
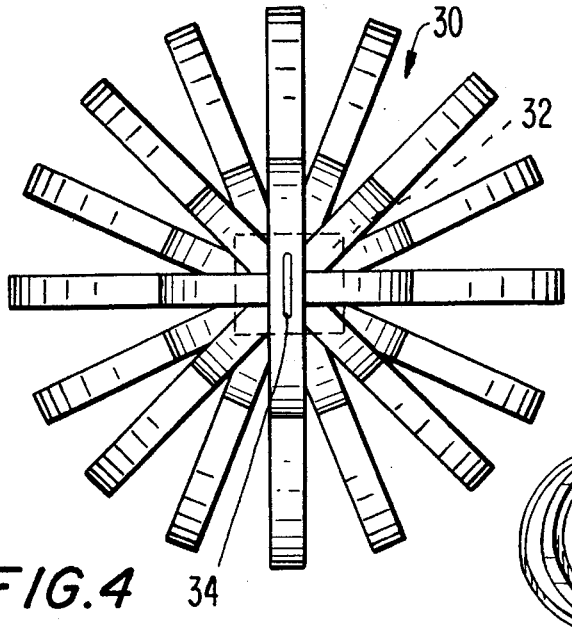
FIG.4
FIG.5
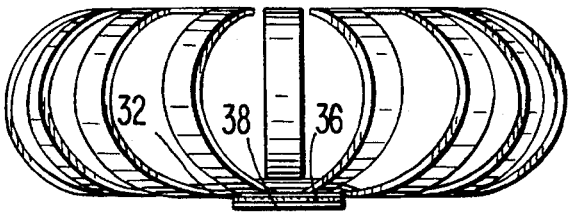

DECORATIVE THREE-DIMENSIONAL, CURLED BOW AND METHOD OF MAKING SAME

BACKGROUND OF THE INVENTION

FIELD OF THE INVENTION

This invention generally relates to a decorative three-dimensional, curled bow and a method of making same.

DESCRIPTION OF THE RELATED ART

In the art of gift wrapping, it is desirable to provide a gift giver with aesthetically pleasing decorations that are easy to apply on a gift or package so that the giver will readily utilize such decorations. The decorations should also be capable of being mass produced so as to bring down manufacturing costs and pricing without compromising the attractive appearance of the decorations.

Decorative ribbon bows formed by pulling a draw-string in situ on the gift or package, as exemplified by U.S. Pat. Nos. 4,515,837; 4,656,064; 3,030,719 and 4,822,648, are known. Bows made by forming individual loops are known from U.S. Pat. Nos. 2,681,525 and 4,900,632. U.S. Pat. No. 4,840,822 discloses a netting bow for use as a gift wrapping product.

Pre-formed ribbon bows and bows formable in situ on the gift or package of the type exemplified by U.S. Pat. Nos. 5,240,750; 3,632,464; and 2,956,362 are prevalent. Lace-like ribbon materials such as disclosed in U.S. Pat. No. 3,676,277 are also known. Crepe paper as disclosed in U.S. Pat. No. 3,560,313 has also been employed. Making loops in fabric strips is taught by U.S. Pat. No. 4,137,352.

Although generally satisfactory for their intended purpose of decorating gift packages, the need persists for aesthetically pleasing and unique decorating materials which are individualistic in appearance and yet producible in large quantities and in a relatively short time so that the decorating materials are reasonably priced.

Also, the decorating materials should be capable of being packed and shipped in a flattened state to save on cargo space, and being erectable in situ on a gift package without damaging the decorating materials and compromising the aesthetic value of the completed bow.

SUMMARY OF THE INVENTION

OBJECTS OF THE INVENTION

It is a general object of this invention to overcome the aforementioned drawbacks of gift wrapping materials currently used.

It is another object of this invention to provide a new decorative, curled bow which is inexpensive to manufacture on a mass-production basis.

Still another object of this invention is to provide a highly ornamental, individualistic and futuristic bow for adorning gifts and like objects.

Yet another object of this invention is to pack and ship the bow in a generally flattened state to conserve cargo space.

An additional object of this invention is to provide a novel decorating material which is easy to handle and self-erectable into a three-dimensional bow.

Yet another object of this invention is to provide a novel method of making an ornamental bow.

FEATURES OF THE INVENTION

In keeping with these objects, and others which will become apparent hereinafter, one feature of this invention resides, briefly stated, in a three-dimensional, curled decorative bow and a method of making the same.

The method includes the step of stretching a first strip, e.g., a long, narrow, elastic ribbon, constituted of a material stretchable from a relaxed, untensioned state to a stretched, tensioned state. The first strip is secured, preferably by a settable adhesive, while it is in the stretched state to a second strip, also a long, narrow ribbon, but constituted of a non-stretched material, to form a laminate. Once the adhesive sets, and the stretching force on the first strip is released, then the first strip self-returns to the relaxed state, thereby forming a laminated curl.

The laminated curl constitutes a decoration which can be applied to a package to be decorated or, for a more ornamental decoration, a plurality of such curls is formed in a pattern. For example, central regions of the curls are juxtaposed, and the curls are equiangularly arranged about an axis that extends through the juxtaposed central regions. Next, the juxtaposed central regions are interconnected to form a fan-shaped pattern.

The curls may be made individually or, preferably, a very long laminate is formed, and thereafter, cut into shorter lengths, each length corresponding to one curl. The curled bow is inexpensive to manufacture on a mass-production basis, is novel in appearance, and is especially suited for adorning gifts and like objects.

For this latter purpose, means are provided at the central regions for attaching the bow to an object to be decorated. The attaching means includes a backing sheet, an adhesive layer on the backing sheet, and a peel-off tab over the adhesive layer. Upon removal of the tab, the adhesive layer can be pressed directly on the object and be adhered to the same.

The laminated curls may be placed between stiff, backing sheets, or in an envelope, to pack the curls in a generally flattened state suitable for shipping. When removed from such packaging, the curls erect themselves into the completed bow.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is an edge view of a stretchable strip prior to being formed into a three-dimensional, curled decorative bow according to this invention;

FIG. 2 is a diagrammatic view of a preferred way of forming a laminate;

FIG. 3 is a side elevational view of a laminated curl;

FIG. 4 is a bottom plan view of the completed bow;

FIG. 5 is a side elevational view of the completed bow of FIG. 4; and

FIG. 6 is a reduced size, exploded, sectional view of a packaged bow in a generally flattened state prior to being formed into the completed bow of FIG. 4.

DETAILED DESCRIPTION OF THE PREFERRED EMBODIMENT

Referring now to the drawings, reference numeral 10 generally identifies a stretchable strip shown in a relaxed, untensioned state in FIG. 1, and in a stretched, tensioned state in FIG. 2. The strip 10 is preferably an elastic ribbon having the property of being immediately returnable to its original size, shape and position once the stretching force on the ribbon has been released.

Thus, elastic ribbon 10 is a long, narrow, generally planar ribbon, preferably made of a fibrous synthetic plastic material. Ribbon 10 has opposite end regions 12, 14 which, when gripped and pulled apart as shown in FIG. 2, in the opposite directions depicted by the arrows A and B, stretch the ribbon 10 to a longer length, for example, at least one and a half times its original length.

FIG. 2 also shows a non-stretched strip 20, also a long, narrow, generally planar ribbon commensurate in size and shape to ribbon 10. Strip 20 can be constituted of paper, plastic, cloth or like flexible material.

A layer 18 of a settable, liquid adhesive is applied between the ribbons 10, 20 which are then placed in overlying, surface-to-surface contact in the direction of the arrows C. The stretching force on ribbon 10 is maintained until the adhesive layer 18 dries and sets.

Once the adhesive layer has set, the stretching force is released, and the resulting laminate forms, as shown in FIG. 3, a curl 22, because the stretched ribbon 10 seeks to return to its original size. The ribbon 10 is located on the inside of the curl; the ribbon 20 is located on the outside of the curl. Curl 22 has a central region 24 and two opposite curled end regions 26, 28.

The curl 22 of FIG. 3 may constitute a bow-like decoration by itself, or preferably, multiple curls 22 are arranged in a decorative pattern. For example, as shown in FIGS. 4 and 5, the central regions 24 of multiple curls 22 are stretched one above another along an axis that extends perpendicularly to the central regions. The curls are equiangularly arranged about this axis to form the illustrated fan shape. The central regions are then connected together to form a completed bow 30.

In a preferred application, the bow 30 is attached to a gift, package or like object. To that end, a backing sheet 32 is connected to the central regions 24, preferably by the staple 34. A pressure-sensitive adhesive layer 36 is coated over the backing sheet 30. A peel-off tab 38 is releasably mounted over the adhesive layer 36.

The tab 38 remains in place until it is desired to adorn the object. Thereupon, the tab 38 is peeled off, and the exposed adhesive layer 36 is pressed against the object, thereby adorning the same.

The curls may be individually formed. Preferably, very long ribbons 10, 20 are employed to form the laminate. Thereupon, the long laminate is cut at regular intervals to form shorter lengths of equal size. Each shorter length corresponds to a single curl 22.

FIG. 6 depicts upper and lower, stiff backing sheets 40, 42 between which the bow 30 in a generally flattened state is sandwiched. To flatten the bow from the three-dimensional state shown in FIG. 5, it is merely necessary to straighten out the curls 22. Upon removing the flattened bow from the backing sheets, the curls self-erect to the curled state of FIG. 5.

The backing sheets may be discrete, cardboard pieces or heavy-duty paper, or may be opposite sides of an envelope. In the preferred commercial embodiment, the lower sheet 42 is a discrete piece of paper, which, together with the flattened bow, are stuffed into an envelope whose upper side constitutes the upper sheet 40. Preferably, the upper side of the envelope is transparent so that the bow can be seen.

It will be understood that each of the elements described above, or two or more together, also may find a useful application in other types of constructions differing from the types described above.

While the invention has been illustrated and described as embodied in a decorative, three-dimensional, curled bow and method of making the same, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

I claim:

1. Method of making a three-dimensional, curled bow, comprising the steps of:

a) stretching a first, generally planar, narrow strip of an elastic, stretchable ribbon from a relaxed state to a stretched state;

b) bonding the first ribbon in the stretched state to a second, generally planar, narrow strip of a non-elastic material by applying an adhesive between the strips;

c) forming a laminated curl having a central region and two, opposite, curled end regions spaced apart of each other by allowing the first ribbon to return to the relaxed state;

d) making additional laminated curls identical to the laminated curl formed in step c);

e) juxtaposing the central region of each curl, and equi-angularly arranging the curled end regions about an upright axis that extends through the juxtaposed central regions to form a fan-shaped pattern; and connecting the juxtaposed central regions together to form the bow.

2. A three-dimensional, curled bow, comprising:

a) a plurality of laminated curls, each curl having a first, generally planar, narrow strip of an elastic ribbon stretched from a relaxed state to a stretched state, a second, generally planar, narrow strip of a non-elastic material, and a settable adhesive between the strips and maintaining the first ribbon in the stretched state until setting of the adhesive, each curl having a central region and two, opposite, curled end regions spaced apart from each other by allowing the first ribbon to return to the relaxed state, said central region of each curl being juxtaposed, said curled end regions of all the curls being equi-angularly arranged about an upright axis that extends through the juxtaposed central regions to form a fan-shaped pattern; and b) means for connecting the juxtaposed central regions together to form the bow.

3. A packaged three-dimensional, curled bow, comprising:

a) a plurality of laminated curls, each curl having a first, generally planar, narrow strip of an elastic ribbon stretched from a relaxed state to a stretched state, a second, generally planar, narrow strip of a non-elastic material, and a settable adhesive between the strips and maintaining the first ribbon in the stretched state until setting of the adhesive, each curl having a central region and two, opposite, curled end regions spaced apart from each other by allowing the first ribbon to return to the relaxed state, said central region of each curl being juxtaposed, said curled end regions of all the curls being equi-angularly arranged about an upright axis that extends through the juxtaposed central regions to form a fan-shaped pattern;

b) means for connecting tile juxtaposed central regions together to form the bow; and c) a pair of backing sheets between which each laminated curl in the relaxed state is sandwiched.

4. The curled bow according to claim 3, wherein one of the sheets is transparent.

* * * * *